US010789874B2

(12) United States Patent
Ahn et al.

(10) Patent No.: US 10,789,874 B2
(45) Date of Patent: Sep. 29, 2020

(54) DISPLAY DEVICE

(71) Applicant: Samsung Display Co., Ltd., Yongin-si, Gyeonggi-do (KR)

(72) Inventors: Yi Joon Ahn, Yongin-si (KR); Jae Joong Kwon, Yongin-si (KR); Jong In Baek, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/363,725

(22) Filed: Mar. 25, 2019

(65) Prior Publication Data

US 2019/0392748 A1 Dec. 26, 2019

(30) Foreign Application Priority Data

Jun. 21, 2018 (KR) ..... 10-2018-0071495

(51) Int. Cl.
*G09G 5/00* (2006.01)
*G09G 3/20* (2006.01)
*G09G 3/3233* (2016.01)

(52) U.S. Cl.
CPC ..... *G09G 3/2003* (2013.01); *G09G 3/3233* (2013.01); *G09G 2300/0452* (2013.01); *G09G 2300/0465* (2013.01); *G09G 2310/08* (2013.01); *G09G 2320/0233* (2013.01); *G09G 2340/0407* (2013.01)

(58) Field of Classification Search
CPC ..... G09G 3/00; G09G 3/20; G09G 3/2003; G09G 3/2025; G09G 3/2983; G09G 3/3225; G09G 3/3233; G09G 3/36; G09G 3/007; G09G 5/00; G09G 2300/0452; G09G 2300/0465; G09G 2310/0224; G09G 2310/08; G09G 2320/0233; G09G 2330/10; G09G 2340/0407; G09G 2340/0457; H01L 27/1288
See application file for complete search history.

(56) References Cited

U.S. PATENT DOCUMENTS 9,613,557 B2 4/2017 Lee et al.
2002/0135731 A1* 9/2002 Wolfe ..... G02F 1/133308 349/192
2004/0036701 A1* 2/2004 Wolfe ..... G09G 3/005 345/672

(Continued)

FOREIGN PATENT DOCUMENTS

KR 10-2006-0086058 A 7/2006
KR 10-2014-0044568 A 4/2014
KR 10-2018-0016061 A 2/2018

OTHER PUBLICATIONS

EPO Partial Search Report dated Nov. 15, 2019, for corresponding European Patent Application No. 19170328.9 (17 pages).

*Primary Examiner* — Michael J Eurice
(74) *Attorney, Agent, or Firm* — Lewis Roca Rothgerber Christie LLP

(57) ABSTRACT

A display device having a display panel including a plurality of pixels connected to scan lines extending in a first direction and data lines extending in a second direction different from the first direction and a panel moving unit for reciprocating the display panel in a third direction with respect to the first direction and the second direction. Each of the plurality of pixels my include a plurality of sub-pixels arranged in a sub-sampled structure.

19 Claims, 11 Drawing Sheets

(56) References Cited

U.S. PATENT DOCUMENTS

2005/0243042 A1* 11/2005 Shivji ..... G09G 3/002
345/82
2007/0080350 A1* 4/2007 Chin ..... H01L 27/1222
257/59
2009/0195855 A1* 8/2009 Steyn ..... G02B 26/02
359/290
2013/0265343 A1* 10/2013 Ninan ..... G09G 3/22
345/690
2013/0285885 A1* 10/2013 Nowatzyk ..... G02B 3/0006
345/8
2015/0015466 A1* 1/2015 Feng ..... G09G 3/2003
345/77
2016/0048015 A1* 2/2016 Mi ..... G02B 27/0025
359/893
2016/0118020 A1* 4/2016 Buckley ..... G09G 3/2022
345/597
2016/0133215 A1* 5/2016 Yeo ..... G09G 3/3648
345/210
2016/0240146 A1* 8/2016 Lee ..... G09G 3/3291
2016/0313558 A1* 10/2016 Gutierrez ..... H02N 1/008
2018/0130400 A1* 5/2018 Meitl ..... G09G 3/007

* cited by examiner

DISPLAY DEVICE

CROSS-REFERENCE TO RELATED APPLICATION

This application claims priority to and the benefit of Korean patent application 10-2018-0071495 filed on Jun. 21, 2018 in the Korean Intellectual Property Office, the entire disclosure of which is incorporated herein by reference.

BACKGROUND

1. Field

The present disclosure generally relates to a display device.

2. Related Art

Display devices provide a connection medium between users and information. With the development of information technologies, the importance of display devices has increased. Accordingly, display devices such as liquid crystal display devices and an organic light emitting display devices are increasingly used.

A display device is configured to display a target image to a user by writing a data voltage for expressing a target gray level for each subpixel. For organic light emitting display devices, the data voltage allows an organic light emitting diode to emit light corresponding to the data voltage. For liquid crystal displays, the data voltage allows light from a backlight unit to be polarized by the controlling orientation of liquid crystals corresponding to the data voltage.

SUMMARY

Embodiments provide a display device capable of improving resolution and image quality by moving a display panel.

According to an aspect of the present disclosure, there is provided a display device including: a display panel including a plurality of pixels connected to scan lines extending in a first direction and data lines extending in a second direction different from the first direction; and a panel moving unit configured to reciprocate the display panel in a third direction at an angle with respect to the first direction and the second direction, wherein each of the plurality of pixels includes a plurality of sub-pixels arranged in a sub-sampled structure.

Each of the plurality of pixels may include: two first sub-pixels each configured to emit green light through a first emission area; a second sub-pixel configured to emit red light through a second emission area; and a third sub-pixel configured to emit blue light through a third emission area.

The second emission area and the third emission area may be on a horizontal line outside of that of the first emission areas.

The second emission area and the third emission area may be located with the first emission areas along the third direction.

The display panel may further include a timing controller configured to drive the display panel in units of frame periods. The frame period may include a first sub-frame period and a second sub-frame period. The plurality of pixels may be configured to emit light during each of the first sub-frame period and the second sub-frame period.

During the frame period, the panel moving unit may reciprocate the display panel by a distance in the third direction.

The distance may refer to a distance between the first emission area and the second emission area.

During the first sub-frame period, the display panel may be moved by the distance to one side of the third direction. During the second sub-frame period, the display panel may be configured to be moved by the distance to the other side of the third direction.

During the first sub-frame period, the display panel may configured to be moved such that the first emission area is moved to a position of the first emission area in an initial state of the display panel. During the second sub-frame period, the display panel may be configured to be moved such that the first emission area is moved to a position of the second emission area in the initial state of the display panel.

The second emission area and the third emission area may be wider than the first emission area.

According to another aspect of the present disclosure, there is provided a display device including: a display panel including a plurality of pixels connected to scan lines extending in a first direction and data lines extending in a second direction different from the first direction; and a panel moving unit configured to reciprocate the display panel along a shape, wherein each of the plurality of pixels includes a plurality of sub-pixels arranged in a Pentile structure, wherein the moving shapes include at least one of a quadrangular shape or a circular shape.

Each of the plurality of pixels may include: two first sub-pixels each configured to emit green light through a first emission area; a second sub-pixel configured to emit red light through a second emission area; and a third sub-pixel configured to emit blue light through a third emission area.

The display panel may further include a timing controller configured to drive the display panel in units of frame periods. The frame period may include first to fourth sub-frame periods. The plurality of pixels may be configured to emit light during each of the first to fourth sub-frame periods.

During the first sub-frame period, the display panel may be moved by a first distance to one side of the first direction. During the second sub-frame period, the display panel may be moved by a second distance to one side of the second direction. During the third sub-frame period, the display panel may be moved by the first distance to the other side of the first direction. During the fourth sub-frame period, the display panel may be moved by the second distance to the other side of the second direction. The first distance may refer to a distance between the first emission area and the second emission area according to the first direction, and the second distance may refer to a distance between the first emission area and the second emission area according to the second direction.

The first distance and the second distance may be the same.

The diameter of the circular shape may be equal to the distance between the first emission area and the second emission area.

According to still another aspect of the present disclosure, there is provided a display device including: a display panel including a plurality of pixels connected to scan lines extending in a first direction and data lines extending in a second direction different from the first direction and a timing controller configured to drive the plurality of pixels in units of frame periods; and a panel moving unit configured to reciprocate the display panel at least twice in any one of the first direction and the second direction during the frame period, wherein each of the plurality of pixels includes a plurality of sub-pixels arranged in a sub-sampled structure.

Each of the plurality of pixels may include: two first sub-pixels each configured to emit green light through a first emission area; a second sub-pixel configured to emit red light through a second emission area; and a third sub-pixel configured to emit blue light through a third emission area.

The second emission area and the third emission area may be on a horizontal line outside of the first emission areas.

The second emission area and the third emission area may be located with the first emission areas along a third direction at an angle with respect to the first direction and the second direction.

According to the present disclosure, the display device can improve resolution and image quality by moving the display panel.

Further, according to the present disclosure, the display device can prevent a screen door effect by improving a fill factor.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
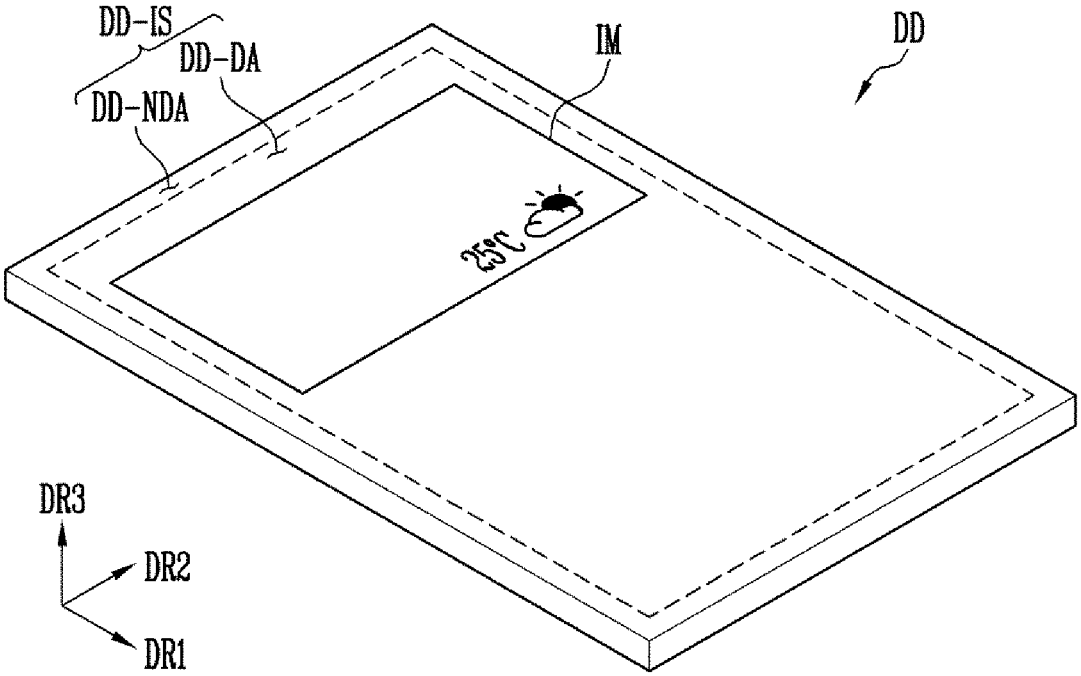
FIG. 1 is a view illustrating a display device according to an embodiment of the present disclosure.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a view illustrating a display device DD according to an embodiment of the present disclosure.

Referring to FIG. 1, the display device DD may include a display surface DD-IS. The display surface DD-IS may be located at a front surface of the display device DD.

The display device DD may display an image IM through the display surface DD-IS. The display surface DD-IS is parallel to a surface defined by a first direction DR1 and a second direction DR2. A normal direction of the display surface DD-IS, i.e., a thickness direction of the display device DD with respect to the display surface DD-IS, is a third direction DR3.

A front surface (or top surface) and a back surface (or bottom surface) of each member or unit described hereinbelow is distinguished by the third direction DR3. However, the first to third directions DR1, DR2, and DR3 illustrated in this embodiment are merely illustrative, and the directions indicated by the first to third directions DR1, DR2, and DR3 are relative concepts, and may be changed into other directions or orientations. Hereinafter, first to third directions are directions respectively indicated by the first to third directions DR1, DR2, and DR3, and are designated by like reference numerals.

In an embodiment of the present disclosure, the display device DD including a planar display surface DD-IS is illustrated, but the present disclosure is not limited thereto. The display device DD may include a curved display surface DD-IS or a stereoscopic display surface DD-IS.

The display device DD according to the embodiment of the present disclosure, may be a rigid display device. However, the present disclosure is not limited thereto, and the display device DD according to the embodiment of the present disclosure, may be a flexible display device.

In the depicted embodiment, a display device DD that is applicable to a mobile phone terminal is, as an example, illustrated. Although not shown in the drawing, electronic modules, a camera module, a power module, and the like, which are mounted on a main board, are located together with the display device DD in a bracket/case, etc., thereby constituting a mobile phone terminal.

The display device DD according to embodiments of the present disclosure may be applied to large-sized electronic devices such as televisions and monitors, as well as medium and small-sized electronic devices such as tablet PCs, vehicle navigation systems, game consoles, smart watches, head mounted displays, and the like.

The display surface DD-IS includes a display area DD-DA in which the image IM is displayed and a non-display area DD-NDA adjacent to the display area DD-DA.

The non-display area DD-NDA may be an area in which the image IM is not displayed. In FIG. 1, temperature and weather images are illustrated as an example of the image IM.

The non-display area DD-NDA may surround the display area DD-DA.

As shown in FIG. 1, the display area DD-DA may have a quadrangular shape. The present disclosure, however, is not limited thereto, and the display area DD-DA and the non-display area DD-NDA may be designed in various shapes (e.g., a rhombus shape, a circular shape, an elliptical shape, an irregular shape, and the like).

Figure 2A:
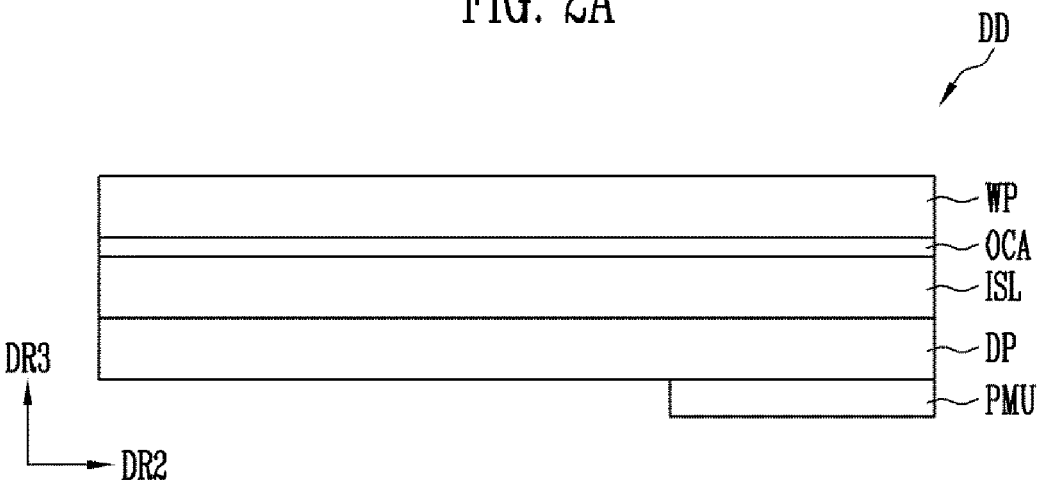
FIGS. 2A and 2B are views illustrating sections of display devices according to embodiments of the present disclosure.
Figure 2B:
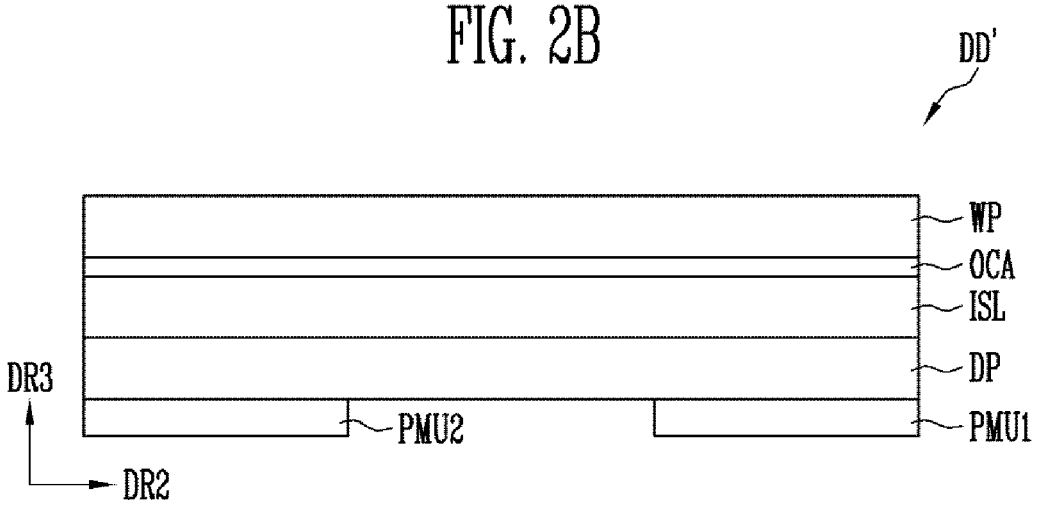

FIGS. 2A and 2B are views illustrating sections of display devices according to embodiments of the present disclosure.

FIGS. 2A and 2B illustrate sections of the display devices, which are defined by a second direction DR2 and a third direction DR3. FIGS. 2A and 2B are simply illustrated to describe stacking relationships between a functional panel and/or functional units, which constitute the display devices.

A display device according to an embodiment of the present disclosure may include a display panel, an input sensing unit, and a window unit. At least some components among the display panel, the input sensing unit, and the window unit may be formed by a continuous process. Alternatively, at least some components among the display panel, the input sensing unit, and the window unit may be coupled to each other through an adhesive member. In FIG. 2, an optically transparent adhesive member OCA is illustrated as a representative example of the adhesive member. The adhesive member described hereinbelow may include a general adhesive or gluing agent.

It should be understood that when a component is formed with another component through a continuous process between the input sensing unit and the window unit, the components may be collectively referred to as a "layer."

Similarly, for components between the input sensing unit and the window unit, when a component is coupled to another component through an adhesive member the components may collectively referred to as a "panel."

The "panel" includes a base layer that provides a base surface, e.g., a synthetic resin film, a composite material film, a glass substrate, and the like, but the base layer may be omitted in the "layer." In other words, the units each expressed as the "layer" are located (e.g., disposed) on a base surface provided by another unit.

The input sensing unit and the window unit may be designated as an input sensing panel and a window panel or an input sensing layer and a window layer depending on the presence of a base layer.

In this specification, that component A is directly disposed or located on component B means that any separate adhesive layer/adhesive member is not between the component A and the component B. Thus, the component B is formed on a base surface provided by the component A through a continuous process after the component A is formed.

Referring to FIG. 2A, the display device DD may include a display panel DP, a panel moving unit PMU, an input sensing layer ISL, and a window panel WP.

The display panel DP may generate an image.

The panel moving unit may be disposed (e.g., located) under the display panel DP. For example, the panel moving unit PMU may entirely or partially overlap with the display panel DP.

The panel moving unit PMU may be connected between the display panel DP and an external case (not shown), to move the display panel DP. For example, the panel moving unit PMU may reciprocate the display panel DP along one or more directions.

In some embodiments, the panel moving unit PMU may move (e.g., reciprocate) the display panel DP along any one of a variety of suitable directions. For example, the panel moving unit PMU may move the display panel according to a quadrangular shape, a circular shape, or any other regular or irregular shape. In some embodiments, the panel moving unit PMU may move the display panel in a reciprocating fashion, such that the display panel travels a distance in a repetitive back and forth motion along a first direction. For example, the display panel DP may start at a first location and panel moving unit PMU may move the display panel DP in a first direction for a distance to a second location. The panel moving unit PMU may then move the display panel DP in a second direction that is opposite to the first direction for the distance to return to the first location. Thus, the panel moving unit PMU may reciprocate the display panel DP along a first direction.

In some embodiments, the panel moving unit PMU may move the display panel DP along any one of at least two directions.

Several embodiments of the present disclosure will be described with reference to FIGS. 7A to 9C.

In some embodiments, the input sensing layer ISL may be directly disposed on the display panel DP. When the input sensing layer ISL is directly disposed on the display panel, the display panel DP and the input sensing layer ISL may be collectively referred to as a display module.

An optically transparent adhesive member OCA may be disposed (e.g., located) between the display module and the window panel WP.

The window panel WP may protect the display panel DP and the input sensing layer ISL from the outside.

In an embodiment of the present disclosure, the display panel DP may be a light emitting display panel, but is not particularly limited. For example, the display panel DP may be an organic light emitting display panel, a quantum dot light emitting display panel, or any other suitable display panel known to those skilled in the art. An emitting layer of the organic light emitting display panel may include an organic light emitting material. An emitting layer of the quantum dot light emitting display panel may include a quantum dot, a quantum rod, and the like. Hereinafter, the display panel DP is described as the organic light emitting display panel.

The input sensing layer ILS may sense a user input (e.g., a touch, a pressure, a fingerprint, etc.). That is, the input sensing layer ISL may acquire coordinate information and/or pressure information based on the user input.

FIG. 2 illustrates that the input sensing layer ISL entirely overlaps with the display panel DP.

Referring to FIGS. 1 and 2A, the input sensing layer ISL may entirely overlap with the display area DD-DA. However, the present disclosure is not limited thereto, and the input sensing layer ISL may partially overlap with the display area DD-DA, or overlap with only the non-display area DD-NDA.

The input sensing layer ISL may be a touch sensing panel for sensing a touch of a user or a fingerprint sensing panel for sensing fingerprint information of a finger of the user.

Referring to FIG. 2B, the display device DD' may include a display panel DP, a first panel moving unit PMU1, a second panel moving unit PMU2, an input sensing layer ISL, and a window panel WP.

In order to avoid redundancy, contents overlapping with those illustrated in FIG. 2A are not described, and the contents illustrated in FIG. 2A may be applied as they are.

The first and second panel moving units PMU1 and PMU2 may be located (e.g., disposed) under the display panel DP. For example, the first and second panel moving units PMU1 and PMU2 may entirely or partially overlap with the display panel DP.

The first and second panel moving units PMU1 and PMU2 may be connected between the display panel DP and an external case (not shown), to move the display panel DP. For example, each of the first and second panel moving units PMU1 and PMU2 may move (e.g., reciprocate) the display panel DP along a direction or along a plurality of directions. That is, for example, the first panel moving unit PMU1 may move the display panel DP along the first direction DR1 (see FIG. 1), and the second panel moving unit PMU2 may move the display panel DP along the second direction DR2 (see FIG. 1) different from the first direction DR1.

However, the present disclosure is not limited thereto, and the panel moving unit PMU may be designed in various manners within a range achieving the advantages of the present disclosure.

Figure 3:
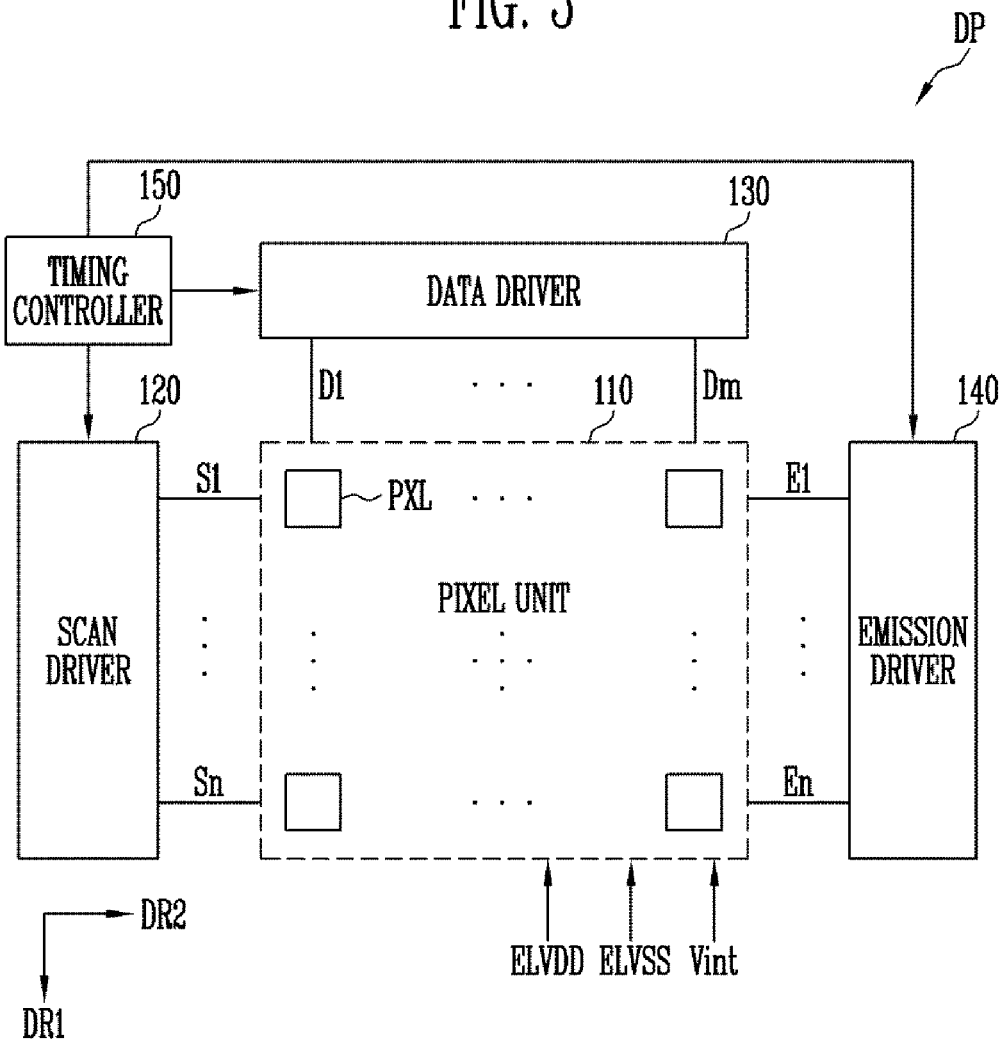
FIG. 3 is a block diagram illustrating a display panel according to an embodiment of the present disclosure.

FIG. 3 is a block diagram illustrating a display panel DP according to an embodiment of the present disclosure.

Referring to FIG. 3, the display panel DP may include a pixel unit 110, a scan driver 120, a data driver 130, an emission driver 140, and a timing controller 150.

In FIG. 3, the scan driver 120, the data driver 130, the emission driver 140, and the timing controller 150 are individually illustrated, but at least some of the components may be integrated according to example embodiments of this disclosure.

The scan driver 120, the data driver 130, the emission driver 140, and the timing controller 150 may be installed in various suitable ways including chip on glass, chip on plastic, tape carrier package, chip on film, and/or the like.

The pixel unit 110 may correspond to the display area DD-DA (see FIG. 1) of the display device DD.

The pixel unit 110 may include a plurality of pixels PXL. For example, the plurality of pixels PXL may be disposed (e.g., located) on a base substrate (not shown).

The pixels PXL may be connected to scan lines S1 to Sn (where n is a natural number). Therefore, the pixels PXL may receive scan signals from the scan driver 120 through the scan lines S1 to Sn.

The pixels PXL may be connected to data lines D1 to Dm (where m is a natural number). Therefore, the pixels PXL may receive data signals from the data driver 130 through the data lines D1 to Dm.

The pixels PXL may be connected to emission control lines E1 to En. Therefore, the pixels PXL may receive emission control signals from the emission driver 140 through the emission control lines E1 to En.

The pixel unit 110 may receive a first power source ELVDD, a second power source ELVSS, and a third power source Vint from a power supply unit (not shown).

The pixels PXL may be arranged in a matrix structure.

For example, the pixels PXL may be arranged at intersection portions of the scan lines S1 to Sn and the data lines D1 to Dm.

In some embodiments, the pixels PXL may be arranged at intersection portions of the emission control lines E1 to En and the data lines D1 to Dm.

Although FIG. 3 illustrates n scan lines S1 to Sn and n emission control lines E1 to En, the present disclosure is not limited thereto. In some embodiments, dummy scan lines or dummy emission control lines may be additionally formed so as to ensure the stability of driving.

The pixels PXL may be connected to the scan lines S1 to Sn, the data lines D1 to Dm, and the emission control lines E1 to En.

For example, the pixels PXL may receive scan signals through the scan lines S1 to Sn, receive emission control signals through the emission control lines E1 to En, and receive data signals through the data lines D1 to Dm.

Each of the pixels PXL may store a voltage corresponding to a data signal supplied thereto.

The pixels PXL may be supplied with the first power source ELVDD, the second power source ELVSS, and the third power source Vint.

In some embodiments, the first power source ELVDD may have a voltage higher than that of the second power source ELVSS. Each of the first power source ELVDD and the second power source ELVSS may have any one of a high-level voltage and a low-level voltage.

The third power source Vint may have a preset voltage. For example, the third power source Vint may have a voltage lower than that of the data signal.

However, the present disclosure is not limited thereto, and each of the first power source ELVDD, the second power source ELVSS, and the third power source Vint may have a voltage within a range (e.g., a predetermined range).

Each of the pixels PXL may control an amount of driving current flowing from the first power source ELVDD to the second power source ELVSS via an organic light emitting diode (not shown), based on the stored voltage. The organic light emitting diode may generate light with a luminance corresponding to the amount of driving current.

The pixels PXL may be driven in units of frames.

In some embodiment, each of the pixels PXL may include a plurality of sub-pixels arranged in a subsampled structure such as a PENTILE® structure (e.g., an RGBG structure). PENTILE® is a registered trademark of Samsung Display Co., Ltd., Republic of Korea. For example, each of the pixels PXL may include two first sub-pixels, a second sub-pixel, and a third sub-pixel. The first sub-pixels may emit green light, the second sub-pixel may emit red light, and the third sub-pixel may emit blue light. The sub-pixel arrangement will be described in detail with reference to FIG. 4.

The scan driver 120 may receive a scan driving control signal from the timing controller 150. For example, the scan driving control signal may include clock signals and a scan start signal. The scan start signal may control supply timings of scan signals, and the clock signals may be used to shift the scan start signal.

The scan driver 120 may generate scan signals in response to the scan driving control signal. For example, the scan signals may have a gate-on voltage at which transistors included in the pixels PXL can be turned on.

The scan driver 120 may be connected to the scan lines S1 to Sn.

The scan driver 120 may supply scan signals to the scan lines S1 to Sn. For example, the scan driver 120 may sequentially the scan signals to the scan lines S1 to Sn.

The data driver 130 may receive a data driving control signal and image data from the timing controller 150. For example, the data driving control signal may include a source start signal, a source output enable signal, a source sampling clock, and the like. The source start signal may control a data sampling start time of the data driver 130. The source sampling clock may control a sampling operation of the data driver 130, based a rising or falling edge. The source output enable signal may control an output timing of the data driver 130.

The data driver 130 may generate data signals, based on a data driving control signal and the image data. For example, the data signals may have voltages within a predetermined range corresponding to the image data.

The data driver 130 may be connected to the data lines D1 to Dm.

The data driver 130 may supply data signals to the data lines D1 to Dm. For example, the data driver 130 may supply the data signals to the data lines D1 to Dm to be synchronized with the sequentially supplied scan signals.

In this specification, the data signal may have a voltage within a range (e.g., a predetermined range) corresponding to the image data.

The emission driver 140 may receive an emission driving control signal from the timing controller 150. For example, the emission driving control signal may include clock signals and an emission start signal. The emission start signal may control supply timings of emission control signals, and the clock signals may be used to shift the emission start signal.

The emission driver 140 may generate emission control signals in response to the emission driving control signal. For example, the emission control signals may have the gate-on voltage at which the transistors included in the pixels PXL can be turned on.

The emission driver 140 may be connected to the emission control lines E1 to En.

The emission driver 140 may supply emission control signals to the emission control lines E1 to En. For example, the emission driver 140 may sequentially supply the emission control signals to the emission control lines E1 to En.

The timing controller 150 may drive the display panel DP or the pixels PXL in units of frame periods.

The timing controller 150 may receive, from a host system (not shown), image data and timing signals (e.g., a vertical synchronization signal, a horizontal synchronization signal, a data enable signal, a clock signal, and the like).

The timing controller 150 may control the components (e.g., the pixel unit 110, the scan driver 120, the data driver 130, and the emission driver 140) of the display panel DP, based on the image data and the timing signals.

For example, the timing controller 150 may transmit the scan driving control signal to the scan driver 120, transmit the data driving control signal to the data driver 130, and transmit the emission driving control signal to the emission driver 140.

Figure 4:
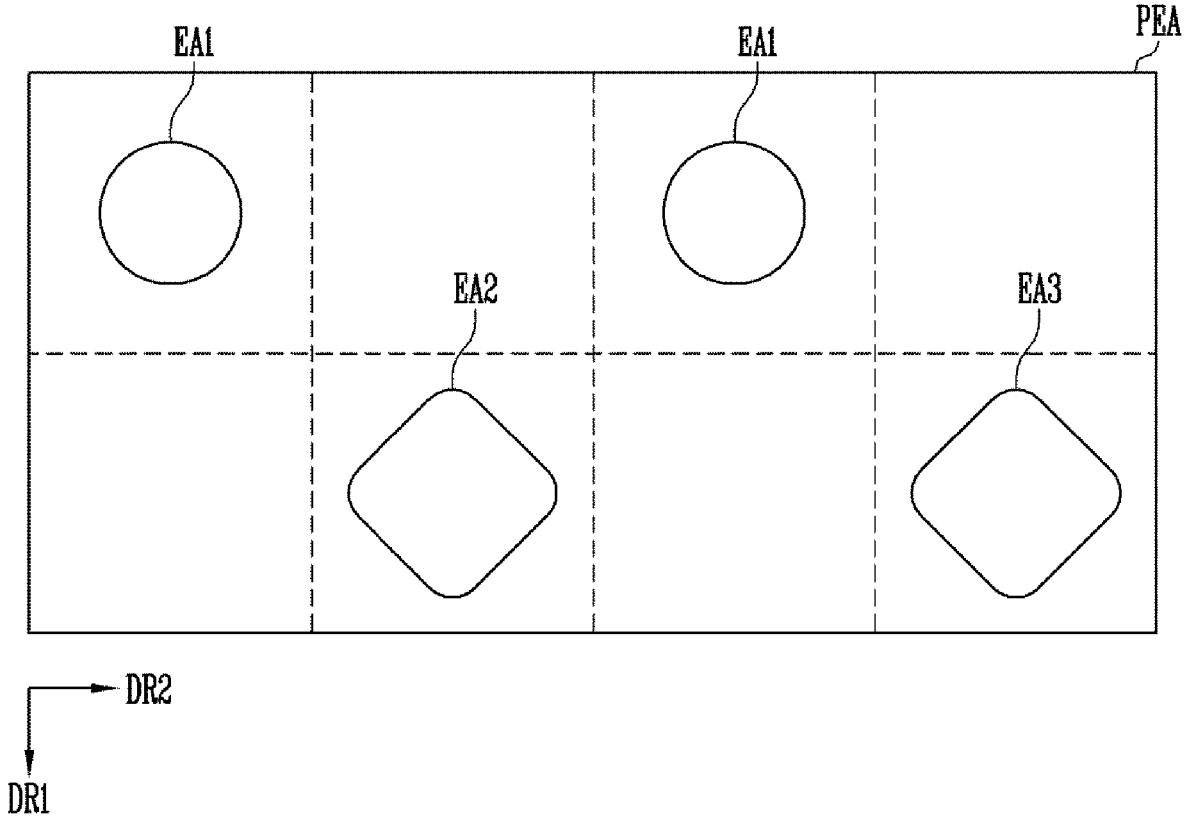
FIG. 4 is a view illustrating a pixel emission area according to an embodiment of the present disclosure.

FIG. 4 is a view illustrating a pixel emission area PEA according to an embodiment of the present disclosure.

FIG. 4 illustrates a pixel emission area PEA that is an emission area of the pixel PXL shown in FIG. 3. For example, FIG. 4 illustrates a pixel emission area PEA on a plane defined by a first direction DR1 and a second direction DR2.

The pixel emission area PEA corresponds to one pixel PXL (see FIG. 3), and means emission areas of the pixel PXL on a plane defined by the first direction DR1 and the second direction DR2.

Referring to FIG. 4, each pixel PXL may include a plurality of sub-pixels. In some embodiments, each pixel PXL may include a plurality of sub-pixels arranged in a sub-sampled sub-pixel structure such as a PENTILE® structure.

For example, each pixel PXL may include two first sub-pixels, a second sub-pixel, and a third sub-pixel. The first sub-pixels may emit green light, the second sub-pixel may emit red light, and the third sub-pixel may emit blue light.

Each of the first sub-pixels may emit green light through a first emission area EA1.

The second sub-pixel may emit red light through a second emission area EA2.

The third sub-pixel may emit blue light through a third emission area EA3.

For example, the first to third emission areas EA1, EA2, and EA3 may correspond to an area in which an anode electrode of an organic light emitting diode OLED (see FIG. 5) is exposed on a plane, an area in which an organic light emitting material on the anode electrode is located on the plane, etc. However, the present disclosure is not limited thereto.

In some embodiments, the second emission area EA2 and the third emission area EA3 may be wider than the first emission area EA1.

The first emission areas EA1 of the first sub-pixels may be located (e.g., disposed) on the same horizontal line. The second emission area EA2 of the second sub-pixel and the third emission area EA3 of the third sub-pixel may be located (e.g., disposed) on the same horizontal line. The second emission area EA2 and the third emission area EA3 may be located (e.g., disposed) on a horizontal line different from that of the first emission area EA1.

As shown in FIG. 4, in one pixel emission area PEA, the first emission area EA1, the second emission area EA2, and the third emission area EA3 may be located (e.g., disposed) on different vertical lines.

That is, the second emission area EA2 and the third emission area EA3 may be located diagonally from the first emission areas EA1 (e.g. along a third direction that is a third direction with respect to the first direction DR1 and the second direction DR2). In various embodiments, the third direction (e.g., a diagonal direction) may bisect the first direction DR1 and the second direction DR2. For example, if the first direction DR1 is perpendicular to the second direction DR2, the third direction may be 45 degrees from the first and second directions DR1 and DR2. However, in other embodiments, the third direction may include any angle relative to the first direction DR1 and the second direction DR2.

Figure 5:
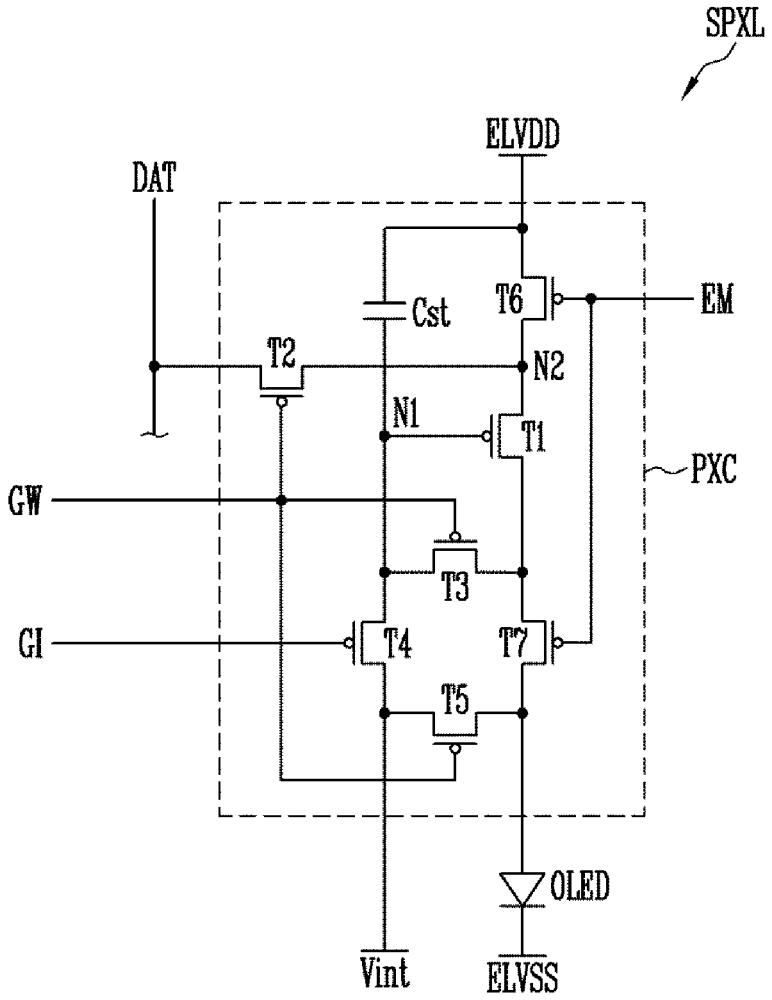
FIG. 5 is a view illustrating a sub-pixel according to an embodiment of the present disclosure.

FIG. 5 is a view illustrating a sub-pixel SPXL according to an embodiment of the present disclosure.

FIG. 5 illustrates a circuit diagram of any one of the plurality of sub-pixels included in the pixel PXL shown in FIG. 3.

Referring to FIG. 5, the sub-pixel SPXL may include an organic light emitting diode OLED and a pixel circuit PXC.

An anode electrode of the organic light emitting diode OLED may be connected to the pixel circuit PXC, and a cathode electrode of the organic light emitting diode OLED may be connected to a second power source ELVSS.

The organic light emitting diode OLED may generate light with a predetermined luminance corresponding to a driving current supplied from the pixel circuit PXC.

The organic light emitting diode OLED may include an emitting layer that emits light of one of primary colors. For example, the primary colors may include at least one of red, green, blue, and white.

A first power source ELVDD may be set to a voltage higher than that of the second power source ELVSS such that a current can flow through the organic light emitting diode OLED.

The pixel circuit PXC may control an amount of driving current flowing from the first power source ELVDD to the second power source ELVSS via the organic light emitting diode OLED, corresponding to a data signal.

The pixel circuit PXC may include a first transistor T1, a second transistor T2, a third transistor T3, a fourth transistor T4, a fifth transistor T5, a sixth transistor T6, a seventh transistor T7, and a storage capacitor Cst.

A first electrode of the first transistor (driving transistor) T1 may be connected to the first power source ELVDD through the sixth transistor T6, and a second electrode of the first transistor T1 may be connected to the anode electrode of the organic light emitting diode OLED. In addition, a gate electrode of the first transistor T1 may be connected to a first node N1.

The first transistor T1 may control an amount of driving current flowing from the first power source ELVDD to the second power source ELVSS via the organic light emitting diode OLED, corresponding to a voltage of the first node N1.

The first node N1 refers to a node commonly connected to the gate electrode of the first transistor T1, the third transistor T3, the fourth transistor T4, and the storage capacitor Cst.

The second transistor T2 may be connected between a data line from which a data signal DAT is supplied and a second node N2. In addition, a gate electrode of the second transistor T2 may be connected to a scan line from which a first gate signal GW is supplied. The second transistor T2 may be turned on when the first gate signal GW is supplied to the scan line. For example, the first gate signal GW may be an ith scan signal (where i is a natural number) supplied to an ith scan line.

When the second transistor T2 is turned on, the data signal DAT is supplied from the data line and the second node N2 may be electrically connected to each other. Therefore, the data signal DAT may be applied to the second node N2.

The second node N2 refers to a node commonly connected to the first transistor T1, the second transistor T2, and the sixth transistor T6.

The third transistor T3 may be connected between the second electrode of the first transistor T1 and the first node N1. In addition, a gate electrode of the third transistor T3 may be connected to the scan line through which the first gate signal GW is supplied. The third transistor T3 may be turned on when the first gate signal GW is supplied to the scan line.

When the third transistor T3 is turned on, the second electrode of the first transistor T1 and the first node N1 may be electrically connected to each other. Therefore, the first transistor T1 may be diode-connected.

The fourth transistor T4 may be connected between the first node N1 and a third power source Vint. In addition, a gate electrode of the fourth transistor T4 may be connected to a scan line through which a second gate signal GI is supplied. The fourth transistor T4 may be turned on when the second gate signal GI is supplied to the scan line. For example, the second gate signal GI may be an (i−1)th scan signal supplied to an (i−1)th scan line.

However, the present disclosure is not limited thereto. In some embodiment, the second gate signal GI may be a scan signal supplied to any one of scan lines S1 to Si−2.

When the fourth transistor T4 is turned on, the first node N1 and the third power source Vint may be electrically connected to each other. Therefore, the third power source Vint may be applied to the first node N1, and the first node N1 may be initialized to the voltage of the third power source Vint.

The fifth transistor T5 may be connected between the anode electrode of the organic light emitting diode OLED and the third power source Vint. In addition, a gate electrode of the fifth transistor T5 may be connected to the scan line through which the first gate signal GW is supplied. The fifth transistor T5 may be turned on when the first gate signal GW is supplied to the scan line.

When the fifth transistor T5 is turned on, the anode electrode of the organic light emitting diode OLED and the third power source Vint may be electrically connected to each other. Therefore, the third power source Vint may be applied to the anode electrode of the organic light emitting diode OLED, and the anode electrode of the organic light emitting diode OLED may be initialized to the voltage of the third power source Vint.

The sixth transistor T6 and the seventh transistor T7 may be located on a path of driving current.

The sixth transistor T6 may be connected between the second node N2 and the first power source ELVDD. In addition, a gate electrode of the sixth transistor T6 may be connected to an emission control line through which an emission control signal EM is supplied. The sixth transistor T6 may be turned on when the emission control signal EM is supplied to the emission control line. For example, the emission control signal EM may be an ith emission control signal supplied to an ith emission control line.

The seventh transistor T7 may be connected between the anode electrode of the organic light emitting diode OLED and the second power source ELVSS. In addition, a gate electrode of the seventh transistor T7 may be connected to the emission control line through which the emission control signal EM is supplied. The seventh transistor T7 may be turned on when the emission control signal EM is supplied to the emission control line.

The storage capacitor Cst may be connected between the first power source ELVDD and the first node N1. The storage capacitor Cst may store a voltage corresponding to the data signal DAT and a threshold voltage of the first transistor T1.

In FIG. 5, an embodiment in which the first to seventh transistors T1 to T7 are implemented with a P-channel MOS transistor is representatively described. It should be understood that in some embodiments, an equivalent N-channel MOS transistor circuit may be implemented, as those skilled in the art would appreciate.

Figure 6:
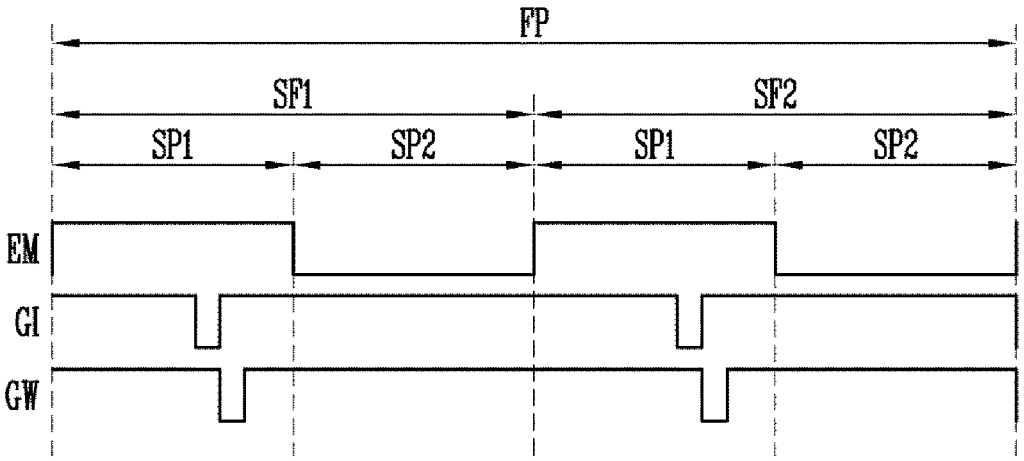
FIG. 6 is a waveform diagram illustrating a driving method of the sub-pixel according to an embodiment of the present disclosure.

FIG. 6 is a waveform diagram illustrating a driving method of the sub-pixel SPXL (see FIG. 5) according to an embodiment of the present disclosure.

Referring to FIGS. 5 and 6, the sub-pixel SPXL may display one image during a frame period FP. The display panel DP (see FIG. 3) and the pixels PXL (see FIG. 3) may be driven in units of frames.

Hereinafter, it is described that the emission control signal EM, the first gate signal GW, and the second gate signal GI have a gate-on voltage. In FIG. 6, the gate-on voltage is illustrated as a low-level voltage, and a gate-off voltage is illustrated as a high-level voltage.

According to the embodiment of the driving method of the sub-pixel SPXL shown in FIG. 6, the frame period FP may include a first sub-frame period SF1 and a second sub-frame period SF2. However, the present disclosure is not limited thereto, and it will be apparent that the frame period FP may include one sub-frame period or three or more sub-frame periods.

Each of the first sub-frame period SF1 and the second sub-frame period SF2 may include a first period SP1 and a second period SP2.

For example, the first period SP1 may mean a non-emission period, and the second period SP2 may mean an emission period.

The first period SP1 and the second period SP2 may be sequentially continued.

During the first period SP1, the second gate signal GI and the first gate signal GW may be sequentially supplied to the scan lines. In addition, the data signal DAT may be supplied to the data line in synchronization with the first gate signal GW.

When the second gate signal GI is supplied, the fourth transistor T4 may be turned on. When the fourth transistor T4 is turned on, the first node N1 may be initialized to the voltage of the third power source Vint.

When the first gate signal GW is supplied, the second transistor T2, the third transistor T3, and the fifth transistor T5 may be turned on.

When the second transistor T2 is turned on, the voltage of the data signal DAT supplied through the data line may be applied to the second node N2.

When the third transistor T3 is turned on, the first transistor T1 may be diode-connected. A voltage obtained by subtracting the threshold voltage of the first transistor T1 from the voltage of the data signal DAT may be applied to the first node N1. Therefore, the storage capacitor Cst may store a voltage corresponding to the difference between the voltage of the first power source ELVDD and the voltage applied to the first node N1. Thus, the threshold voltage of the first transistor T1 can be compensated.

When the fifth transistor T5 is turned on, the voltage of the third power source Vint may be applied to the anode electrode of the organic light emitting diode OLED. Therefore, the anode electrode of the organic light emitting diode OLED may be initialized to the voltage of the third power source Vint.

During the second period SP2, the emission control signal EM may be supplied.

When the emission control signal EM is supplied, the sixth transistor T6 and the seventh transistor T7 may be turned on.

When the sixth transistor T6 and the seventh transistor T7 are turned on, the driving current flows through the organic light emitting diode OLED, and the organic light emitting diode OLED may generate light (e.g., predetermined light). Therefore, the sub-pixel SPXL may emit light.

Thus, based on the contents illustrated in FIGS. 5 and 6, the plurality of pixels PXL can emit lights during each of the first sub-frame period SF1 and the second sub-frame period SF2.

Figure 7A:
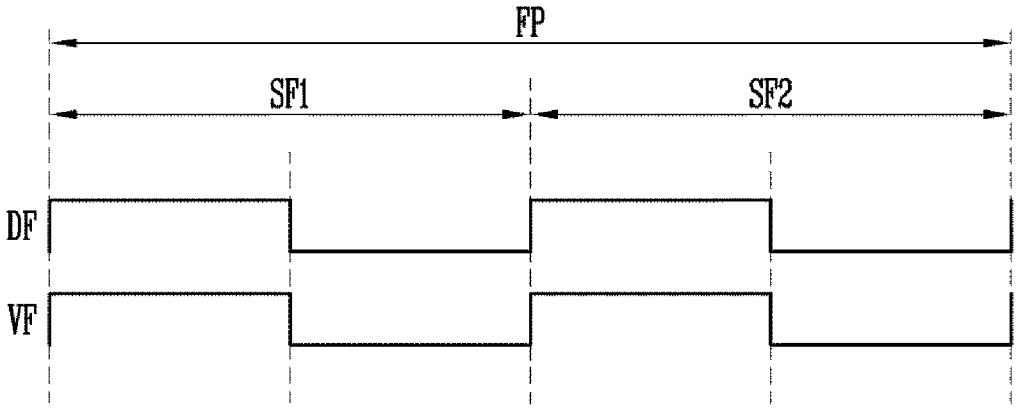
FIGS. 7A and 7B are views illustrating a driving method of the display device according to an embodiment of the present disclosure.
Figure 7B:
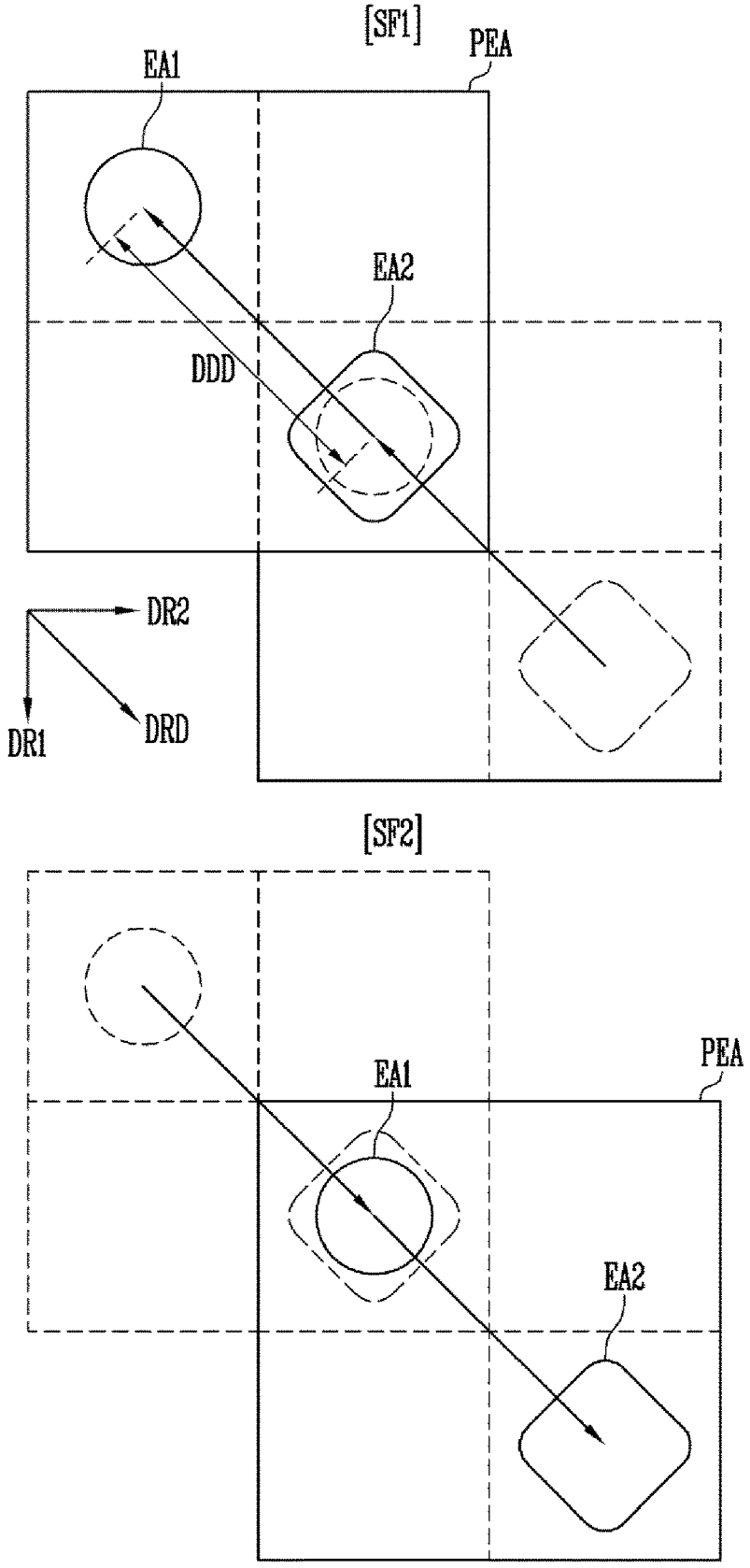

FIGS. 7A and 7B are views illustrating a driving method of the display device according to an embodiment of the present disclosure.

Referring to FIG. 7A, a frame period FP may include a first sub-frame period SF1 and a second sub-frame period SF2.

A driving frequency DF exemplarily illustrated in FIG. 7A may mean a frequency at which the display panel DP (see FIG. 3) is driven based on the contents illustrated in FIGS. 3 to 6.

A motion frequency VF exemplarily illustrated in FIG. 7A may refer to a frequency at which the panel moving unit PMU (see FIG. 2A) is driven according to example embodiments of the present disclosure.

As shown in FIG. 7A, the motion frequency VF may correspond to the driving frequency DF. Therefore, during each of the first sub-frame period SF1 and the second sub-frame period SF2, the panel moving unit PMU (see FIG. 2A) may move the display panel DP (see FIG. 3) along a preset motion path.

FIG. 7B illustrates a pixel emission area PEA of the pixel PXL (see FIG. 3) of the display panel DP (see FIG. 3), which is moved by the panel moving unit PMU (see FIG. 2A) during each of the first sub-frame period SF1 and the second sub-frame period SF2. For convenience of description, only the first emission area EA1 and the second emission area EA2 in the pixel emission area PEA shown in FIG. 4 are illustrated in FIG. 7B, but contents described in FIG. 7B may be applied to the other areas.

Referring to FIGS. 2A, 3, 7A, and 7B, the panel moving unit PMU may move (e.g., reciprocate) the display panel DP along a third direction DRD during the frame period FP.

The third direction DRD may mean a third direction with respect to the first direction DR1 and the second direction DR2.

In some embodiments, as the panel moving unit PMU is driven, the display panel DP may be moved. For example, the display panel DP may be moved such that the first emission area EA1 is moved to an initial state (e.g., a first initial position) for the first sub-frame period SF1. Additionally, the display panel DP may be moved such that the first emission area EA1 is moved to an initial state (e.g., a second initial position) for the second sub-frame period SF2. The initial state may mean a state before the display panel DP is moved by the panel moving unit PMU.

In some embodiments, during the frame period FP, the panel moving unit PMU may move (e.g., reciprocate) the display panel DP by a distance DDD (e.g., a diagonal distance) along the third direction DRD. The distance DDD may mean a distance between the first emission area EA1 and the second emission area EA2.

For example, as the panel moving unit PMU is driven, the display panel DP may be moved by the diagonal distance DDD to one side of the third direction DRD during the first sub-frame period SF1. In addition, the display panel DP may be moved by the diagonal distance DDD to the other side of (e.g., opposite to) the third direction during the second sub-frame period SF2.

Although FIG. 7B illustrates that the panel moving unit PMU linearly moves the display panel DP, the present disclosure is not limited thereto. In some embodiments, the panel moving unit PMU may move the display panel DP along at least one of a curve, a bent line, and a combination thereof.

Figure 8A:
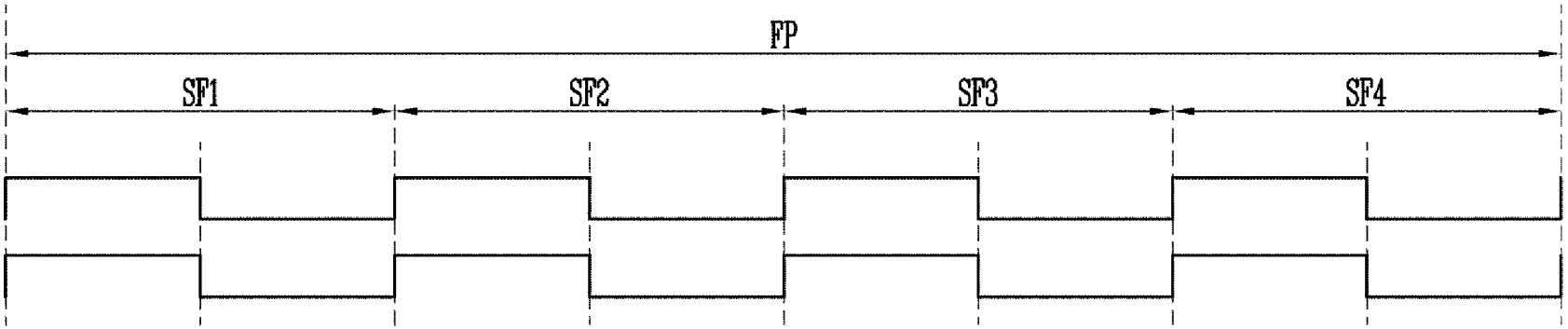
FIGS. 8A to 8C are views illustrating a driving method of the display device according to an embodiment of the present disclosure.
Figure 8B:
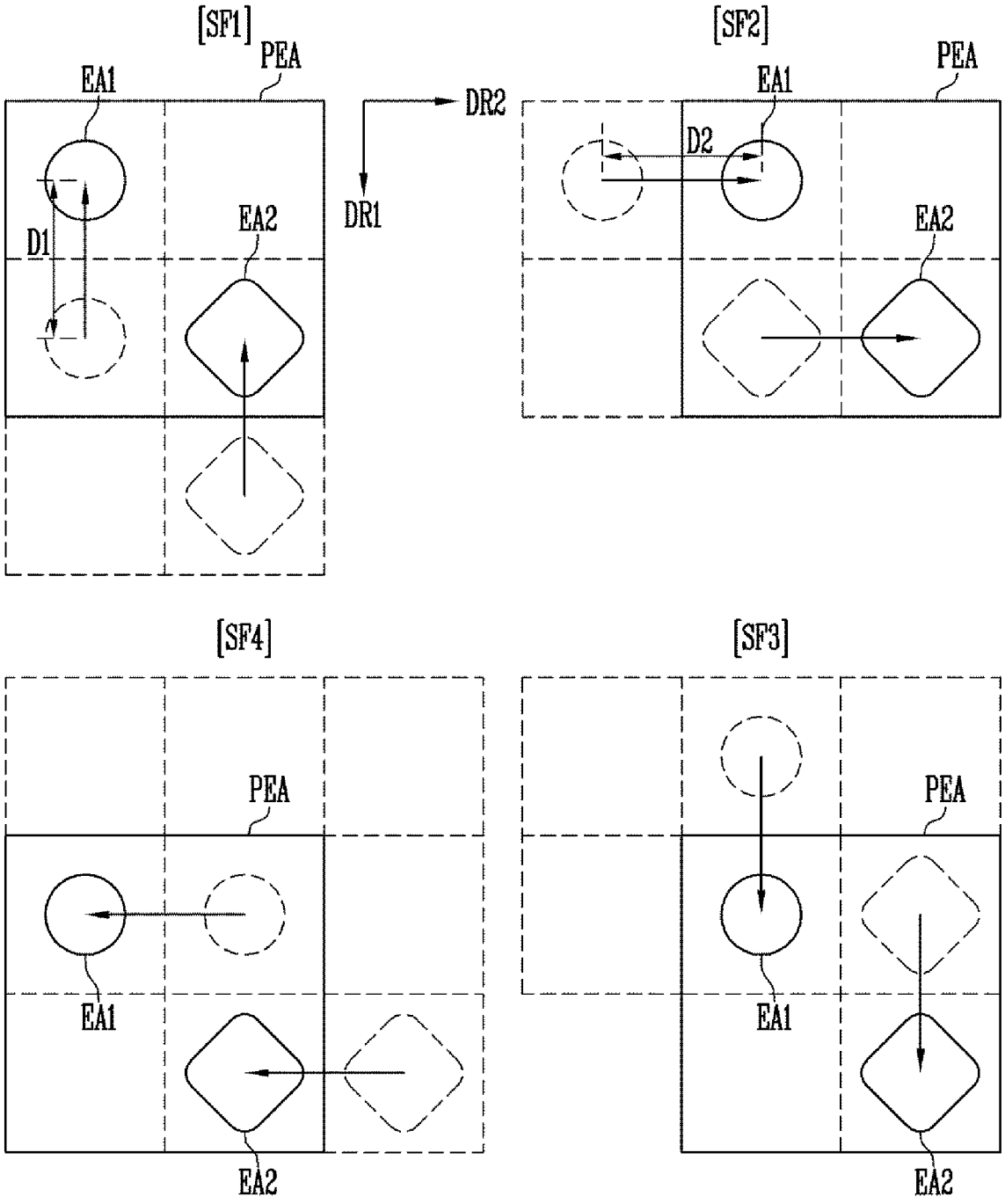

FIGS. 8A and 8B are views illustrating a driving method of the display device according to an embodiment of the present disclosure.

Referring to FIG. 8A, a frame period FP may include first to fourth sub-frame periods SF1, SF2, SF3, and SF4.

A driving frequency DF exemplarily illustrated in FIG. 8A may mean a frequency at which the display panel DP (see FIG. 3) is driven based on the contents illustrated in FIGS. 3 to 6.

A motion frequency VF exemplarily illustrated in FIG. 8A may refer to a frequency at which the panel moving unit PMU (see FIG. 2A) is driven according to example embodiments of the present disclosure.

As shown in FIG. 8A, the motion frequency VF may correspond to the driving frequency DF. Therefore, during each of the first to fourth sub-frame periods SF1, SF2, SF3, and SF4, the panel moving unit PMU (see FIG. 2A) may move the display panel DP (see FIG. 3) along a motion path (e.g., a preset motion path).

Figure 8C:
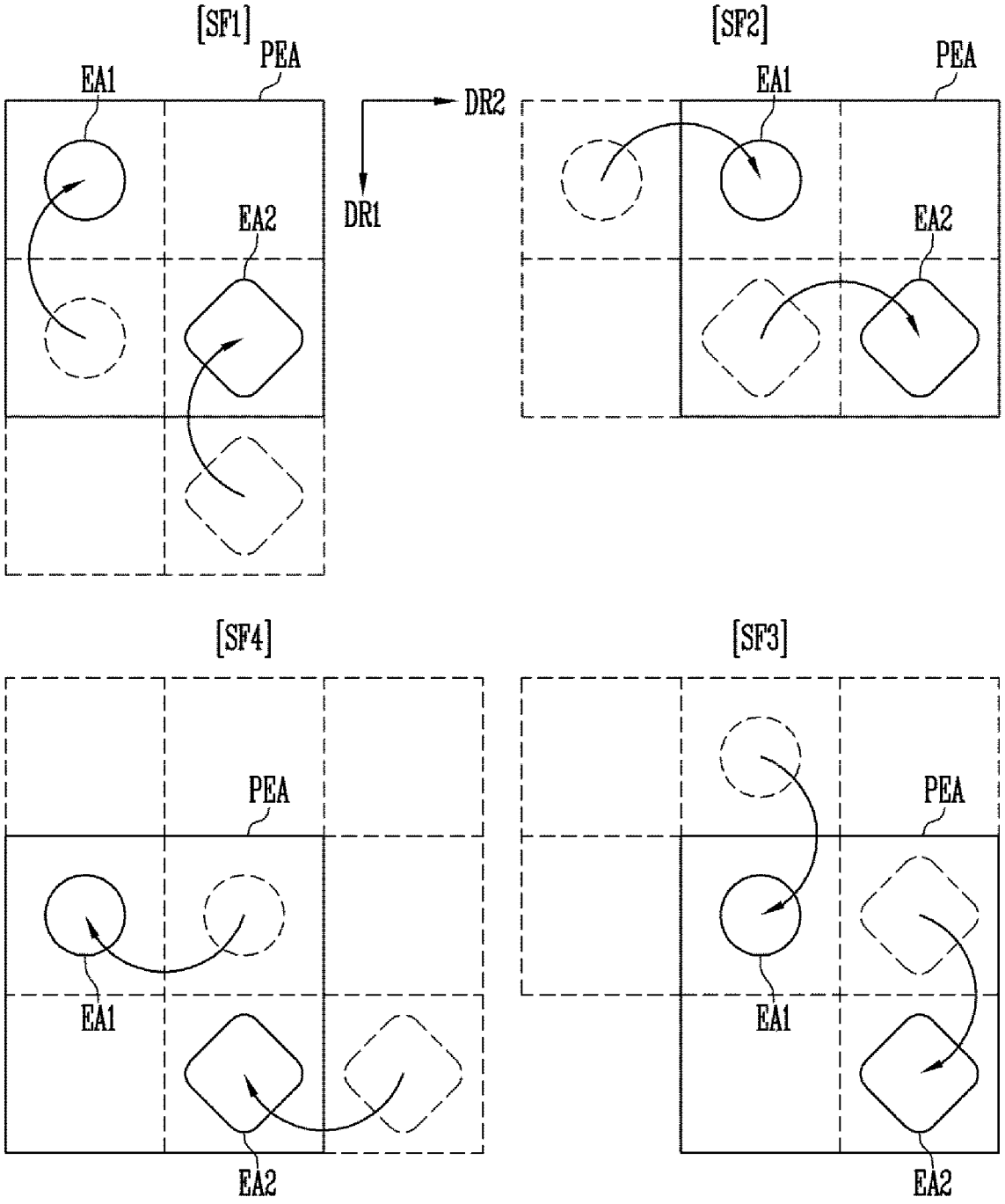

FIGS. 8B and 8C illustrate a pixel emission area PEA of the pixel PXL (see FIG. 3) of the display panel DP (see FIG. 3), which is moved by the panel moving unit PMU (see FIG. 2A) during each of the first to fourth sub-frame periods SF1, SF2, SF3, and SF4. For convenience of description, only the first emission area EA1 and the second emission area EA2 in the pixel emission area PEA shown in FIG. 4 are illustrated in FIGS. 8B and 8C, but contents described in FIGS. 8B and 8C may be applied to the other areas.

Referring to FIGS. 2A, 3, 8A, and 8B, the panel moving unit PMU may reciprocate the display panel DP according to a shape during the frame period FP. The shape may, for example include at least one of a quadrangular shape, a circular shape, or any other suitable shape.

For example, as the panel moving unit PMU is driven, the display panel DP may be moved such that the first emission area EA1 is moved to a position where the first emission area EA1 is in an initial state (e.g., an a first initial location) during the first sub-frame period SF1. In various embodiments, the locations at which the panel moving unit PMU positions the display panel may be considered different states. In some embodiments, the display panel DP may be moved such that the first emission area EA1 is moved to a position of a non-emission area (e.g., an area that does not include the first emission area EA1 and the second emission area EA2 in the pixel emission area PEA) in the initial state (e.g., at a second initial location) during the second sub-frame period SF2. In another example, the display panel DP may be moved such that the first emission area EA1 is moved to a position of the second emission area EA2 in the initial state (e.g., at a third initial location) during the third sub-frame period SF3. In yet another example, the display panel DP may be moved such that the first emission area EA1 is moved to a position of the non-emission area in the initial state (e.g., at a fourth initial location) during the fourth sub-frame period SF4. Thus, in this example, the display panel DP may be moved so that the various emission areas (e.g., the first emission area EA1 and the second emission area EA2) may sequentially move through 4 different locations.

As shown in FIG. 8B, the position of the non-emission area may be variously set.

In some embodiments, the panel moving unit PMU may reciprocate the display panel DP along a quadrangular shape during the frame period FP.

For example, as the panel moving unit PMU is driven, the display panel DP may be moved by a first distance D1 to one side of the first direction DR1 during the first sub-frame period SF1. Additionally, the display panel DP may be moved by a second distance D2 to one side of the second direction DR2 during the second sub-frame period SF2. The display panel DP may be moved by the first distance D1 to the other side of the first direction DR1 (e.g., opposite to the first side of the first direction DR1) during the third sub-frame period SF3. The display panel DP may be moved by the second distance D2 to the other side of the second direction DR2 (e.g., opposite to the first side of the second direction DR2) during the fourth sub-frame period SF4. For example, in some embodiments, the panel moving unit PMU may move the display panel DP to the right by a first distance D1, up by a second distance D2, left by the first distance D1, and down by the second distance D2 and may reciprocate the display panel DP along this path.

The first distance D1 may mean a distance between the first emission area EA1 and the second emission area EA2 according to the first direction DR1, and the second distance D2 may mean a distance between the first emission area EA and the second emission area EA2 according to the second direction DR2.

In some embodiments, the first distance DR1 and the second distance D2 may be the same.

Although FIG. 8B illustrates that the panel moving unit PMU linearly moves the display panel DP, the present disclosure is not limited thereto. In some embodiments, the panel moving unit PMU may move the display panel DP along at least one of a curve, a bent line, and a combination thereof.

Referring to FIGS. 2A, 3, 8A, and 8C, the panel moving unit PMU may move (e.g., reciprocate) the display panel DP along a circular shape during the frame period FP.

The diameter of the circular shape may be equal to the distance between the first emission area EA1 and the second emission area EA2.

Figure 9A:
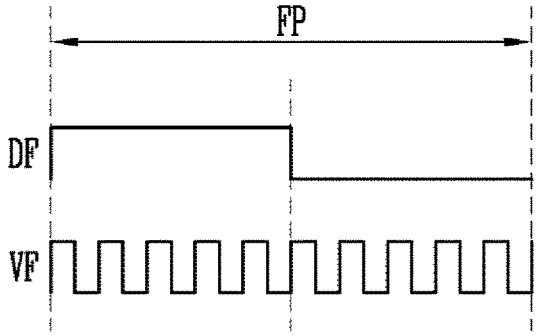
FIGS. 9A to 9C are views illustrating a driving method of the display device according to an embodiment of the present disclosure.
Figure 9B:
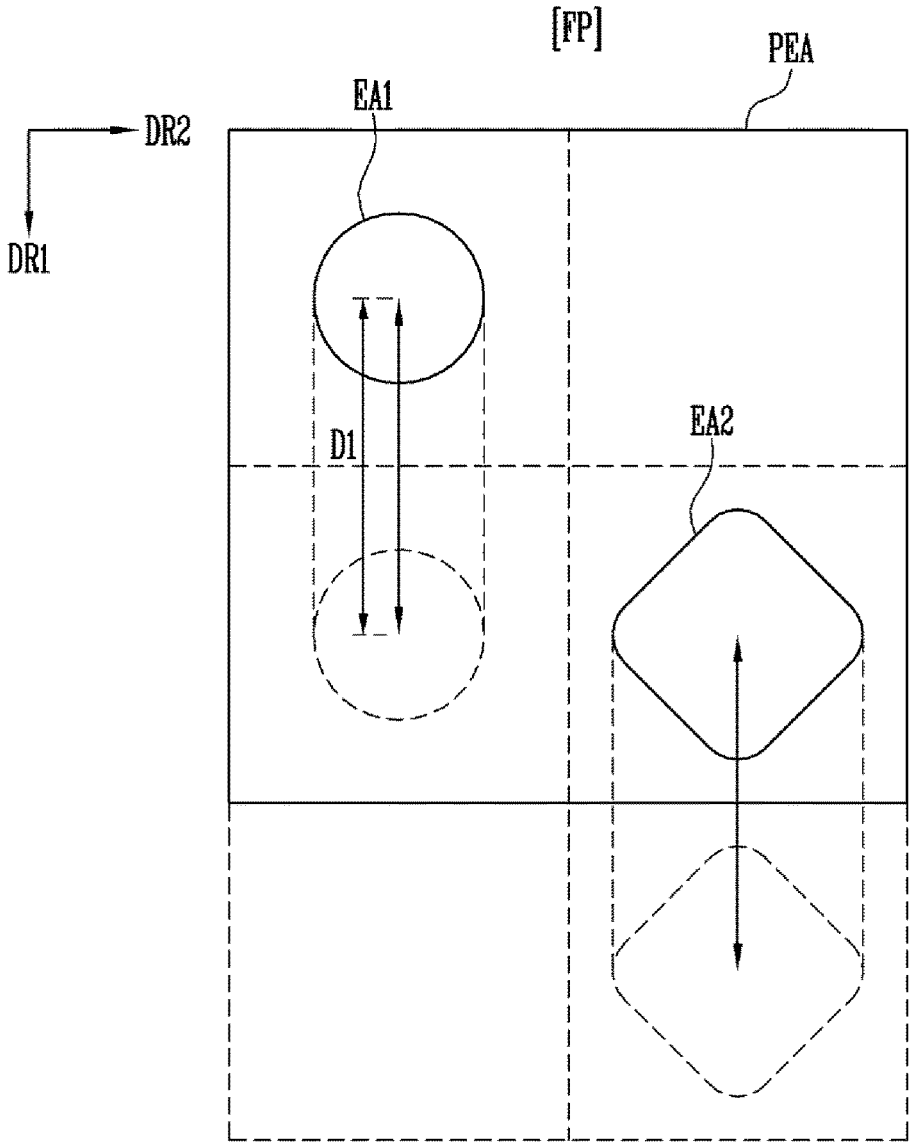

FIGS. 9A and 9B are views illustrating a driving method of the display device according to an embodiment of the present disclosure.

Referring to FIG. 9A, the display panel DP (see FIG. 3) may be driven in units of frame periods FP without separate time-divisionally driving.

A driving frequency DF exemplarily illustrated in FIG. 9A may mean a frequency at which the display panel DP (see FIG. 3) is driven based on the contents illustrated in FIGS. 3 to 6.

A motion frequency VF exemplarily illustrated in FIG. 9A may refer to a frequency at which the panel moving unit PMU (see FIG. 2A) is driven according to example embodiments of the present disclosure.

As shown in FIG. 9A, the motion frequency VF may correspond to k times (where k is a natural number of 2 or more) the driving frequency DF. Therefore, during the frame period FP, the panel moving unit PMU (see FIG. 2A) may move the display panel DP (see FIG. 3) along a motion path (e.g., along a preset motion path).

In FIG. 9A, a case where the motion frequency VF is ten times of the driving frequency DF is illustrated as an example. However, the present disclosure is not limited thereto.

Figure 9C:
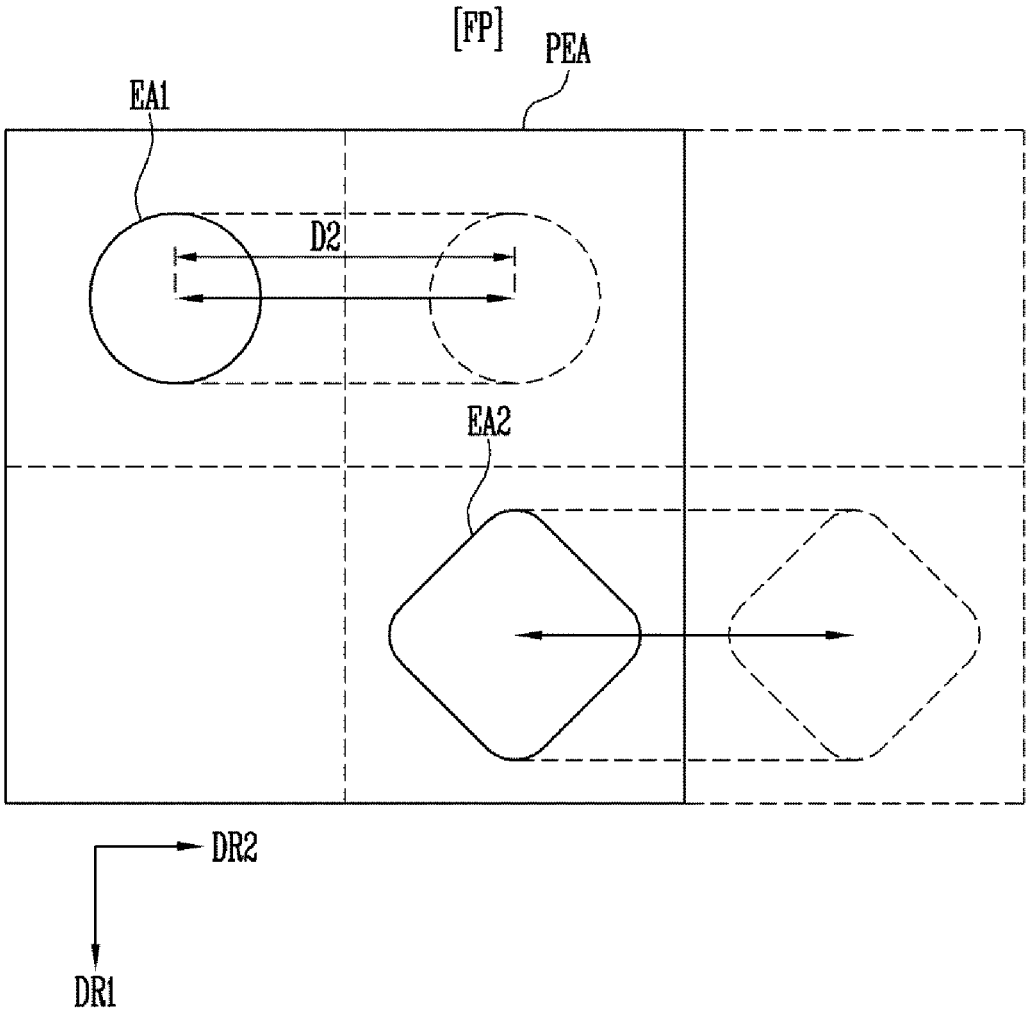

FIGS. 9B and 9C illustrate a pixel emission area PEA of the pixel PXL (see FIG. 3) of the display panel DP (see FIG. 3), which is moved by the panel moving unit PMU (see FIG. 2A) during the frame period FP. For convenience of description, only the first emission area EA1 and the second emission area EA2 in the pixel emission area PEA shown in FIG. 4 are illustrated in FIGS. 9B and 9C, but contents described in FIGS. 9B and 9C may be applied to the other areas.

Referring to FIGS. 2A, 3, 9A, and 9B, the panel moving unit PMU may reciprocate the display panel at least twice in the first direction DR1 during the frame period FP.

For example, as the panel moving unit PMU is driven, the display panel DP may be reciprocated at least twice between a first position and a second position. For example, the display panel DP may be reciprocated at least twice between an initial state position of the first emission area EA1 (e.g., at an initial location) and a position of the non-emission area in the initial state during the frame period FP. The initial state may mean a state (e.g., a location) before the display panel DP is moved by the panel moving unit PMU.

In some embodiments, the panel moving unit PMU may reciprocate the display panel DP at least twice by a first distance D1 in the first direction DR1 during the frame period FP.

Although FIG. 9B illustrates that the panel moving unit PMU linearly moves the display panel DP, the present disclosure is not limited thereto. In some embodiments, the panel moving unit PMU may move the display panel DP along at least one of a curve, a bent line, and a combination thereof.

Referring to FIGS. 2A, 3, 9A, and 9C, the panel moving unit PMU may reciprocate the display panel DP at least twice in the second direction DR2 during the frame period.

For example, as the panel driving unit PMU is driven, the display panel DP may be reciprocated at least twice between a position of the first emission area EA1 in the initial state and a position of the non-emission area in the initial state during the frame period FP.

In some embodiments, the panel driving unit PMU may reciprocate the display panel DP at least twice by a second distance D2 in the second direction DR2 during the frame period FP.

Although FIG. 9C illustrates that the panel moving unit PMU linearly moves the display panel DP, the present disclosure is not limited thereto. In some embodiments, the panel moving unit PMU may move the display panel DP along at least one of a curve, a bent line, and a combination thereof.

Thus, the display device according to the present disclosure can improve resolution and image quality by moving the display panel.

Further, the display device according to the present disclosure can prevent a screen door effect by improving a fill factor.

The fill factor means a ratio of an emission area per unit area of a display surface, and the screen door effect means that a non-emission area between emission areas is viewed by a user.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims.

What is claimed is:

1. A display device comprising:

a display panel comprising a plurality of pixels connected to scan lines extending in a first direction and data lines extending in a second direction different from the first direction; and a panel moving unit configured to reciprocate the display panel in a third direction at an angle with respect to the first direction and the second direction, wherein each of the plurality of pixels includes a plurality of sub-pixels arranged in a sub-sampled structure, wherein the display panel comprises a timing controller configured to drive the display panel in units of frame periods, wherein each frame period comprises a first sub-frame period and a second sub-frame period, and wherein the panel moving unit is configured to reciprocate the display panel such that the plurality of pixels are configured to emit light from different locations during each of the first sub-frame period and the second sub-frame period.

2. The display device of claim 1, wherein each of the plurality of pixels comprises:

two first sub-pixels each configured to emit green light through first emission areas;

a second sub-pixel configured to emit red light through a second emission area; and a third sub-pixel configured to emit blue light through a third emission area.

3. The display device of claim 2, wherein the second emission area and the third emission area are wider than the first emission area.

4. The display device of claim 2, wherein the second emission area and the third emission area are on a horizontal line outside of that of the first emission areas.

5. The display device of claim 4, wherein the second emission area and the third emission area are located along the third direction from the first emission areas.

6. The display device of claim 1, wherein, during each frame period, the panel moving unit is configured to reciprocate the display panel by a distance in the third direction.

7. The display device of claim 2, wherein, during each frame period, the panel moving unit is configured to reciprocate the display panel by a distance in the third direction, and wherein the distance comprises a distance between a first emission area of the first emission areas and the second emission area.

8. The display device of claim 7, wherein, during the first sub-frame period, the display panel is configured to be moved by the distance to one side of the third direction, and wherein, during the second sub-frame period, the display panel is moved by the distance to the other side of the third direction.

9. The display device of claim 7, wherein, during the first sub-frame period, the display panel is moved such that the first emission area is moved to a position of the first emission area in an initial state of the display panel, and wherein, during the second sub-frame period, the display panel is moved such that the first emission area is moved to a position of the second emission area in the initial state of the display panel.

10. A display device comprising:

a display panel comprising a plurality of pixels connected to scan lines extending in a first direction and data lines extending in a second direction different from the first direction; and a panel moving unit configured to reciprocate the display panel according to a shape, wherein each of the plurality of pixels includes a plurality of sub-pixels arranged in a sub-sampled structure, wherein the shape comprises at least one of a quadrangular shape or a circular shape, wherein the display panel comprises a timing controller configured to drive the display panel in units of frame periods, wherein each frame period comprises a first sub-frame period and a second sub-frame period, and wherein the panel moving unit is configured to reciprocate the display panel such that the plurality of pixels are configured to emit light from different locations during each of the first sub-frame period and the second sub-frame period.

11. The display device of claim 10, wherein each of the plurality of pixels comprises:

two first sub-pixels each configured to emit green light through first emission areas;

a second sub-pixel configured to emit red light through a second emission area; and a third sub-pixel configured to emit blue light through a third emission area.

12. The display device of claim 11, wherein each frame period further comprises a third sub-frame period and a fourth sub-frame period, and wherein the plurality of pixels are further configured to emit light during each of the third and the fourth sub-frame periods.

13. The display device of claim 12, wherein the diameter of the circular shape is equal to a distance between the first emission area and the second emission area.

14. The display device of claim 12, wherein, during the first sub-frame period, the display panel is configured to be moved by a first distance to one side of the first direction, wherein, during the second sub-frame period, the display panel is configured to be moved by a second distance to one side of the second direction, wherein, during the third sub-frame period, the display panel is configured to be moved by the first distance to the other side of the first direction, and wherein, during the fourth sub-frame period, the display panel is configured to be moved by the second distance to the other side of the second direction, wherein the first distance refers to a distance between the first emission area and the second emission area according to the first direction, and the second distance refers to a distance between the first emission area and the second emission area according to the second direction.

15. The display device of claim 14, wherein the first distance and the second distance are the same.

16. A display device comprising:

a display panel comprising a plurality of pixels connected to scan lines extending in a first direction and data lines extending in a second direction different from the first direction and a timing controller configured to drive the plurality of pixels in units of frame periods; and a panel moving unit configured to reciprocate the display panel at least twice in at least one of the first direction and the second direction during the frame period, wherein each of the plurality of pixels comprises a plurality of sub-pixels arranged in a sub-sampled structure.

17. The display device of claim 16, wherein each of the plurality of pixels comprises:

two first sub-pixels each configured to emit green light through first emission areas;

a second sub-pixel configured to emit red light through a second emission area; and a third sub-pixel configured to emit blue light through a third emission area.

18. The display device of claim 17, wherein the second emission area and the third emission area are on a horizontal line outside of that of the first emission areas.

19. The display device of claim 18, wherein the second emission area and the third emission area are located along a third direction from the first emission areas, the third direction at an angle with respect to the first direction and the second direction.

* * * * *